US005507328A

United States Patent [19]

Donovan

[11] Patent Number: 5,507,328

[45] Date of Patent: Apr. 16, 1996

[54] POURING SPOUT

[76] Inventor: Terrence Donovan, 305 W. Mercury, #207, Butte, Mont. 59701

[21] Appl. No.: 274,472

[22] Filed: Jul. 13, 1994

[51] Int. Cl.[6] ..... B65B 1/04; B65B 3/04

[52] U.S. Cl. ..... 141/291; 141/357

[58] Field of Search ..... 141/291, 292, 141/293, 294, 295, 296, 354, 352, 357, 355

[56] References Cited

U.S. PATENT DOCUMENTS

| | | | |
|---|---|---|---|
| 1,354,599 | 10/1920 | Curtiss | 141/292 |
| 2,963,205 | 12/1960 | Beall, Jr. | 141/292 |
| 3,072,883 | 2/1963 | Beall, Jr. | 141/198 |
| 3,181,576 | 5/1965 | Pellerino et al. | 141/295 X |
| 3,207,190 | 9/1965 | Silbereis et al. | 141/292 X |
| 3,278,094 | 10/1966 | Perry | 141/291 X |
| 3,606,096 | 9/1971 | Campbell | 141/292 X |
| 4,667,710 | 5/1987 | Wu | 141/292 X |
| 4,834,151 | 5/1989 | Law | 141/198 |
| 4,924,921 | 5/1990 | Simmel et al. | 141/286 |
| 4,946,079 | 8/1990 | Campbell | 222/484 |
| 4,958,668 | 9/1990 | Vachon | 141/291 |
| 5,076,333 | 12/1991 | Law | 141/291 X |
| 5,107,909 | 4/1992 | Donovan | 141/296 |
| 5,118,015 | 6/1992 | Scholle et al. | 222/489 |
| 5,234,038 | 8/1993 | Mitchell et al. | 141/293 |
| 5,249,611 | 10/1993 | Law | 141/198 |

FOREIGN PATENT DOCUMENTS

| | | | |
|---|---|---|---|
| 555799 | 1/1957 | Italy | 141/292 |

*Primary Examiner*—Henry J. Recla
*Assistant Examiner*—Steven O. Douglas

[57] ABSTRACT

A self-venting, self-stopping pouring spout for use when pouring liquid from a supply container into a target container is provided. The pouring spout attaches to the supply container. The pouring spout further has a self-venting conduit through which liquid and air pass between the target container and the supply container. The self-venting conduit has a tubular configuration and includes a spout body which has a flange that seals against the supply container opening. The self-venting conduit further has a travelling tube which lies within the spout body and seals with the flange of the spout body providing a valve for regulating the transfer of fluid and air between the supply container and the target container. The valve is normally biased in a closed position and movable from the closed position to the open position to provide for fluid and air transfer.

18 Claims, 7 Drawing Sheets

POURING SPOUT

BACKGROUND OF THE INVENTION

This invention pertains to a self-venting, self-stopping pouring spout for use when pouring liquid from a supply container into a target container. The pouring spout is of the type where liquid flow is automatically stopped when the fluid level in the target container is nearly full.

With pouring spouts several problems can occur when transferring liquid from a supply container to a target container. Once the supply container is tipped to begin the transfer, liquid tends to surge down the spout, often reaching the spout exit opening before the spout tip is safely inside the target container. If the liquid is flammable or toxic, a dangerous spill can occur at the time liquid is just starting to be transferred. If high temperature sources are nearby, such as with a chain saw or a lawnmower, the spill can become a significant safety hazard at the time the liquid is being transferred.

Conventional spouts connected to a supply container generally do not prevent spillage when the supply container is initially tilted into a target container, nor spillage when the spout is removed from the target container. As the target container becomes full, conventional spouts must be tilted upright rapidly to raise the exit opening of the Spout above the liquid level.

Conventional spouts may have an elongate vent that extends from the supply container into the target container. When the fluid level in the target container reaches the air intake opening in the vent, the flow is stopped. As the liquid rises above the air intake opening a vacuum is created in the supply container which stops the flow of additional liquid. When conventional spouts are lifted above the surface of the liquid in the target container, the vacuum in the supply container ceases and the liquid will resume flowing in the spout.

It can be seen that a need exists for a pouring spout which can be attached to a supply container and placed in a target container with the flow of liquid through the pouring spout initially stopped when the pouring spout is being inserted into the target container. Further, a need exists for a pouring spout that prevents spillage when the pouring spout is being lifted from the target container and tilted to an upright resting position. Further, a need exists for a pouring spout which is self-stopping and self-venting when the pouring spout is engaged with the target container during liquid transfer between the target container and the supply container.

SUMMARY OF THE INVENTION

The present invention provides for a self-venting, self-stopping pouring spout for transferring fluid from a supply container into a target container. A means of attachment is provided by which the pouring spout is attached in airtight manner to the supply container. The means of attachment secures the pouring spout to the supply container by a flange on the pouring spout being attached to the opening of the supply container.

The pouring spout has a self-venting conduit through which liquid and air pass between the supply container and the target container. The self-venting conduit has a tubular configuration and includes a spout body, which spout body has a tubular configuration and a flange. The self-venting conduit further includes a travelling tube which has a tubular configuration and is slidably received within the spout body. The travelling tube has a flange which seals with the flange of the spout body. The self-venting conduit has from one to a plurality of six air vent channels which extend longitudinally the length of the self-venting conduit to from one to a plurality of six air vent ports. The air vent ports provide air passage from the air vent channels into the interior of the supply container. The travelling tube has from one to a plurality of six liquid ports which provide for passage of fluid into a common liquid channel in the travelling tube from the interior of the supply container.

One embodiment, the self-venting conduit includes a sleeve, which sleeve is of tubular configuration and is slidably received within the spout body and disposed between the spout body and the travelling tube. The sleeve and travelling tube are constrained to slide within the spout body as one unit.

The pouring spout has a valve means for regulating the transfer of fluid from the supply container through the pouring spout into the target container. The valve means are normally biased in a closed position and moveable from the closed position to an open position, which open position allows for the passage of air and fluid through the pouring spout. The valve means has a hook, which hook has a flange. The hook is secured in position on the spout body by means of a distal end of the hook abutting an under edge of a lip of the travelling tube and being forced thereto by a spring biasing means.

The valve means are normally biased in closed position. Such biasing of the valve means in closed position is provided by spring biasing means. Pressure on the hook in a direction proximate to the supply container compresses the spring biasing means and forces the travelling tube, and sleeve if so configured, in the direction proximate to the supply container, unseating the flange on the spout body and the flange on the travelling tube, and opening the air vent ports and the liquid ports.

In one embodiment, the spring biasing means comprises an external spring and in another embodiment, the spring biasing means comprises an internal spring.

The valve means may include a hook ring which encircles the hook and attaches thereto by snap or other appropriate means.

BRIEF DESCRIPTION OF THE DRAWINGS

In order that the invention may be clearly understood and readily carried into effect a preferred embodiment of the invention will now be described, by way of example only with reference to the accompanying drawings wherein.

DETAILED DESCRIPTION OF THE PREFERRED EMBODIMENTS

Figure 1:
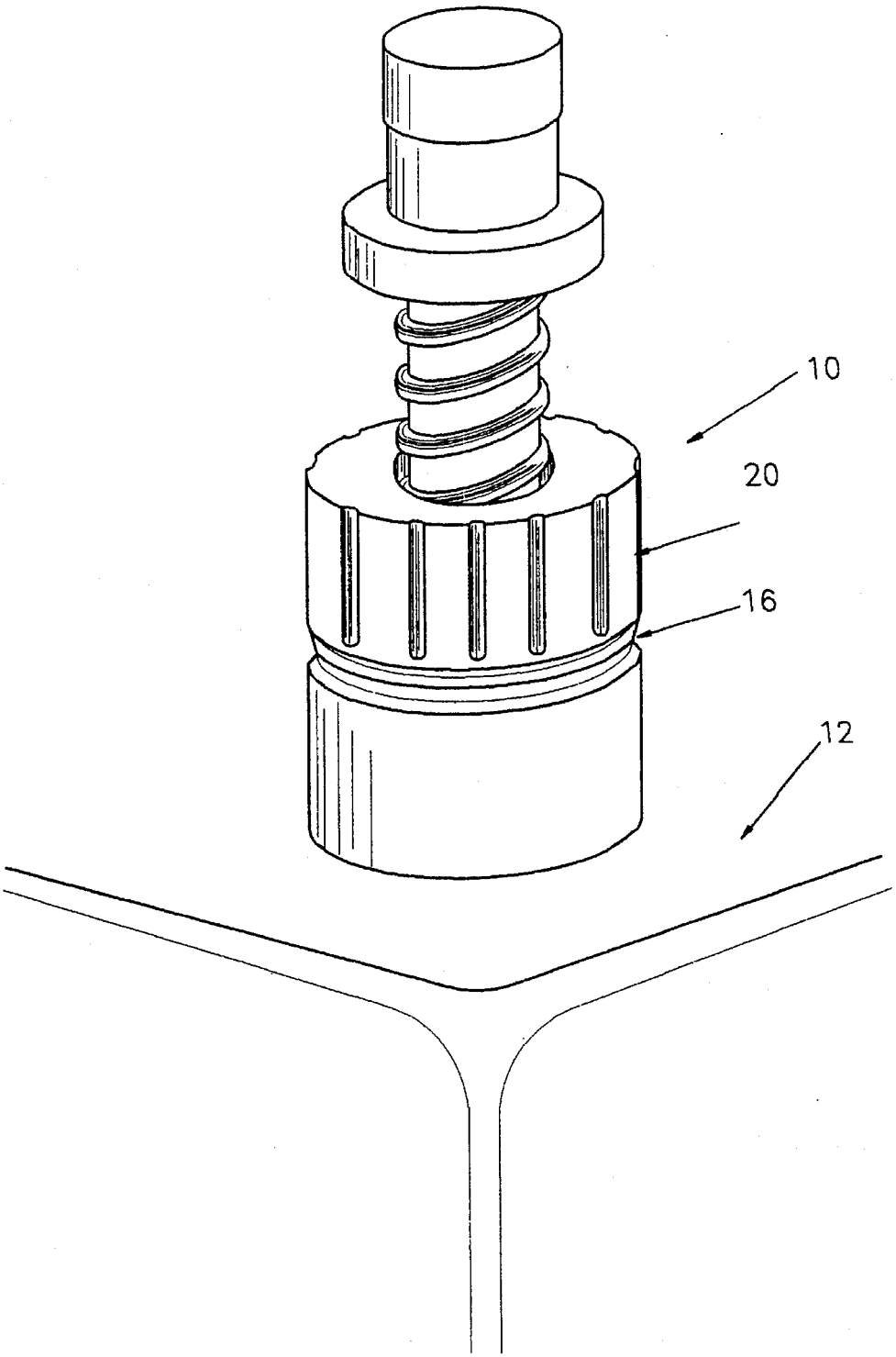
FIG. 1 is a perspective view of one embodiment of a pouring spout of the present invention shown attached to a supply container.

FIG. 1 illustrates a pouring spout 10 attached to a supply container 12 for transferring fluid from the supply container 12 to a target container. Throughout this description references are made to inner planar surface and outer planar surface, which references are to be read consistently as meaning inner planar surface being that surface in closest proximity to the supply container 12 when the pouring spout 10 is attached to the supply container 12, and outer planar surface being that surface most distal from the supply container 12 when the pouring spout 10 is attached to the supply container 12. Additionally, in this description, references are made to proximate end and distal end, which references are to be read consistently as meaning proximate end being that end closest to the supply container 12 when the pouring spout 10 is attached to the supply container 12, and distal end being that end farthest away from the supply container 12 when the pouring spout 10 is attached to the supply container 12.

A means of attachment 20 is provided by which the pouring spout 10 is attached to the supply container 12. The means of attachment 20 provides an airtight seal between the pouring spout 10 and the interior of the supply container 12 when the means of attachment 20 is secured onto the supply container 12, which airtight seal prevents leakage of the contents of the supply container 12 during the pouring operation. The means of attachment 20 secures the pouring spout 10 to the supply container 12 by means of a flange 34 on a spout body 30 of the pouring spout 10 being attached to an opening in the supply container 12. An inner planar surface 38 of the flange 34 on the spout body 30 seats on and seals with the opening in the supply container 12, and is secured in place thereon by the means of attachment 20.

By way of illustration, and not limitation, one embodiment of the means of attachment 20 is an annular, threaded collar which encircles the pouring spout 10 and has threads which cooperate with a correspondingly threaded mouth 16 of the supply container 12 by threadably engaging the threads of the threaded mouth 16 of the supply container 12 to attach the flange 34 on the spout body 30 of the pouring spout 10 to the threaded mouth 16 of the supply container 12 through the combination of internal threads on the annular, threaded collar and external threads on the threaded mouth 16 of the supply container 12.

Figure 4:
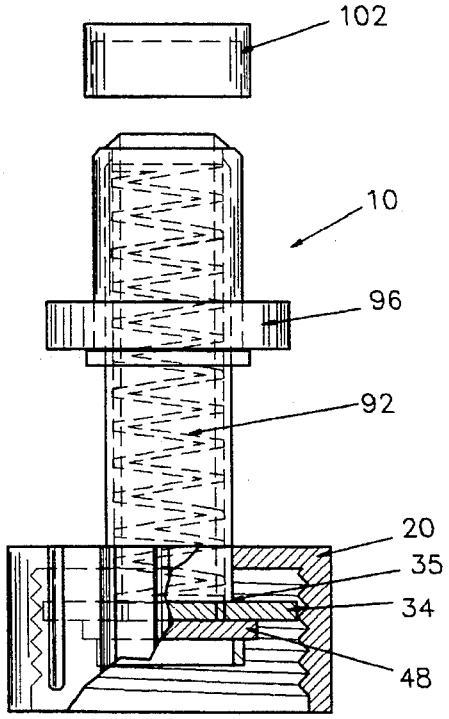
FIG. 4 is a longitudinal section of the pouring spout with the interior spring of the spring biasing means shown.
Figure 8:
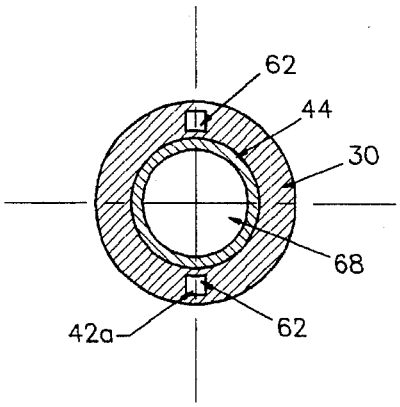
FIG. 8 is a top plan view of one embodiment of the pouring spout showing the spout body with two air vent channels incorporated therein.
Figure 10:
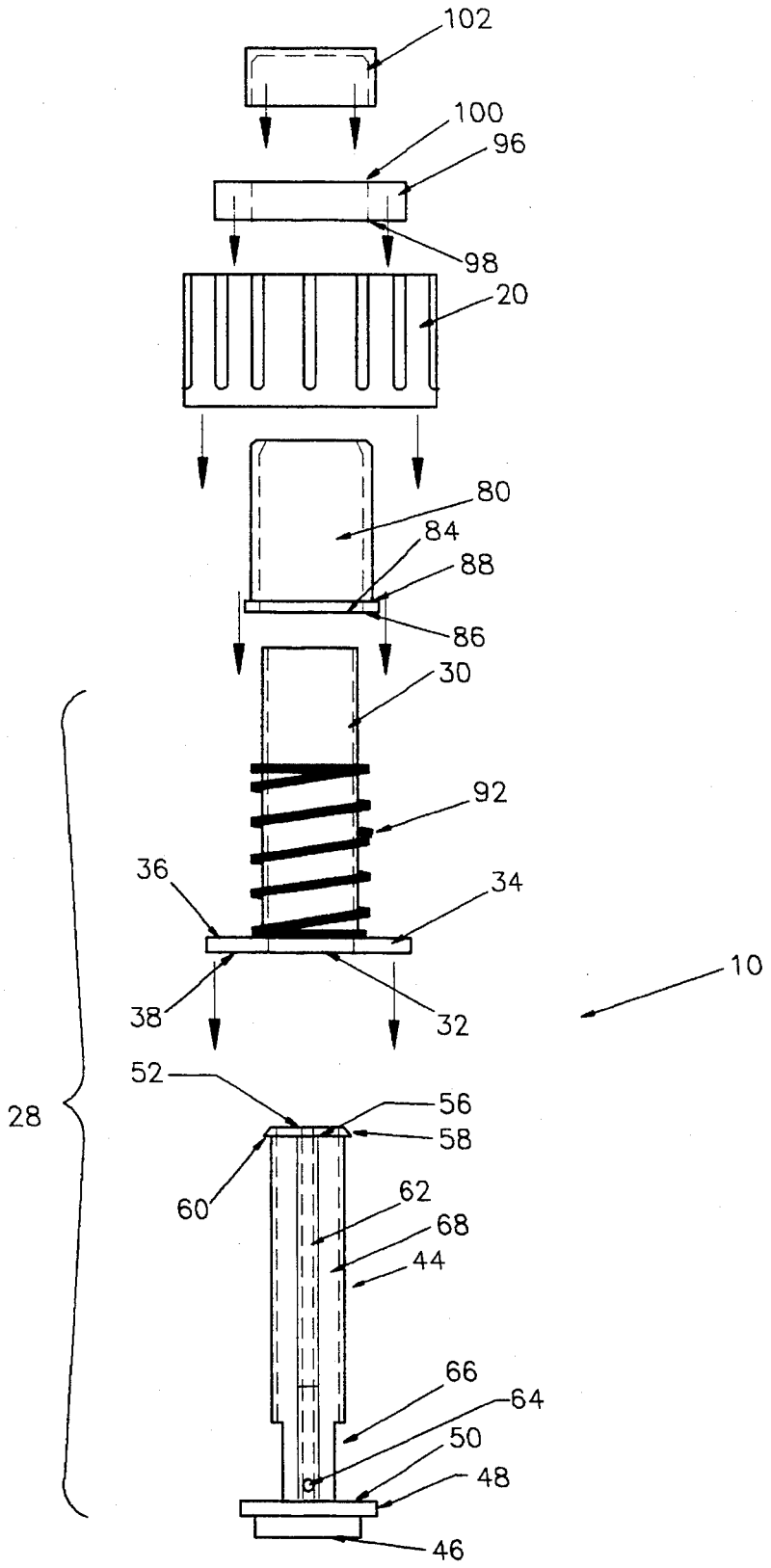
FIG. 10 is an exploded view of the components of one embodiment of the pouring spout having no sleeve.
Figure 11:
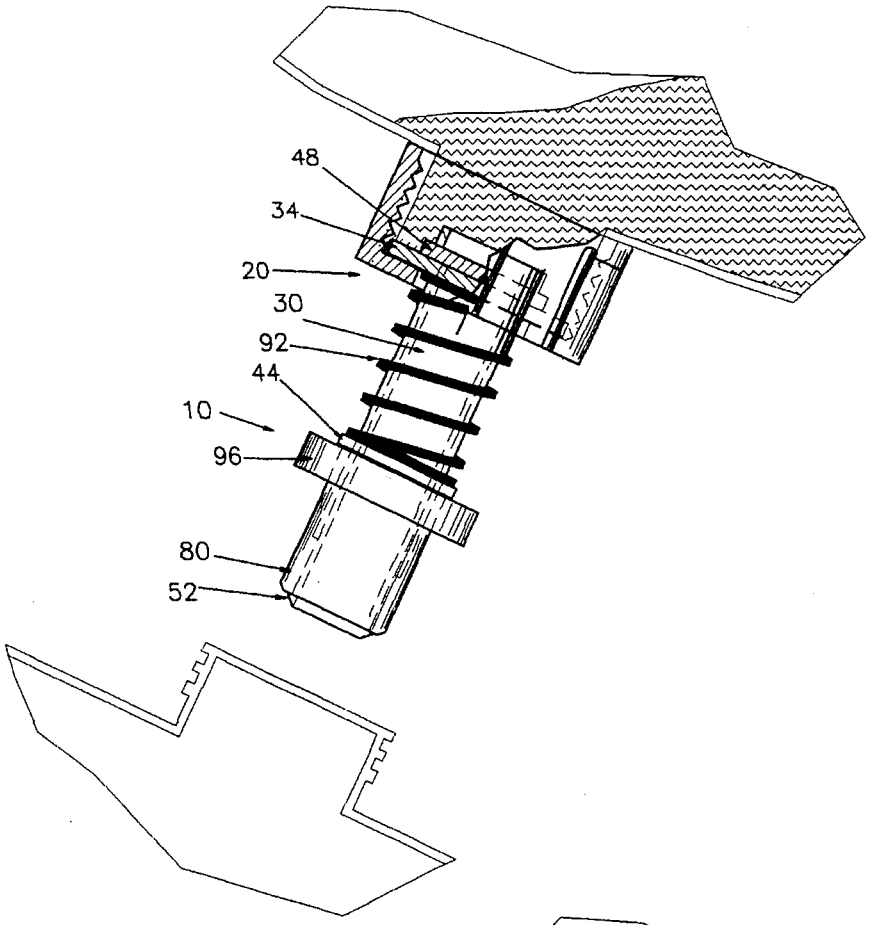
FIG. 11 is a cross-sectional view of the pour spout having an exterior spring shown in pouring configuration with the valve means closed.
Figure 12:
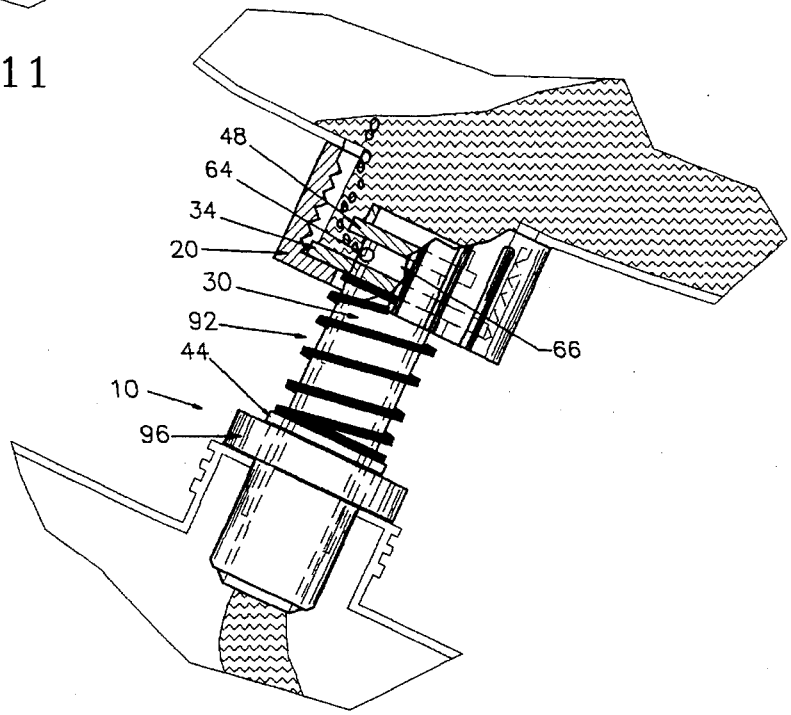
FIG. 12 is a cross-sectional view of the pour spout having an exterior spring shown in pouring configuration with the valve means open.
Figure 13:
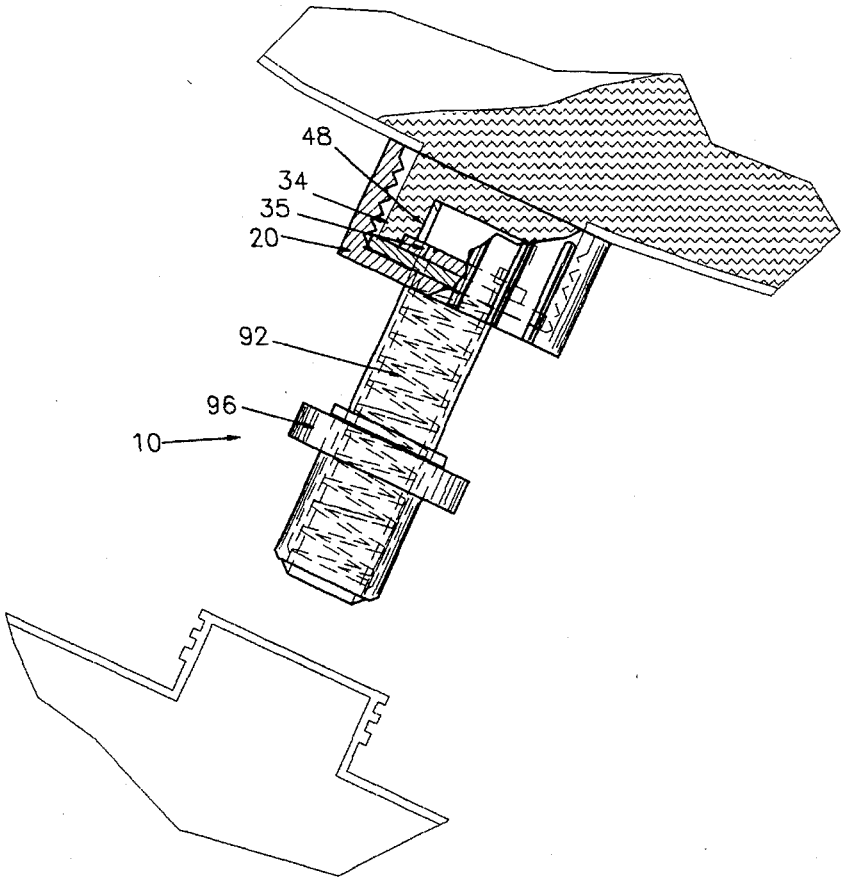
FIG. 13 is a cross-sectional view of the pour spout having an interior spring shown in pouring configuration with the valve means closed.
Figure 14:
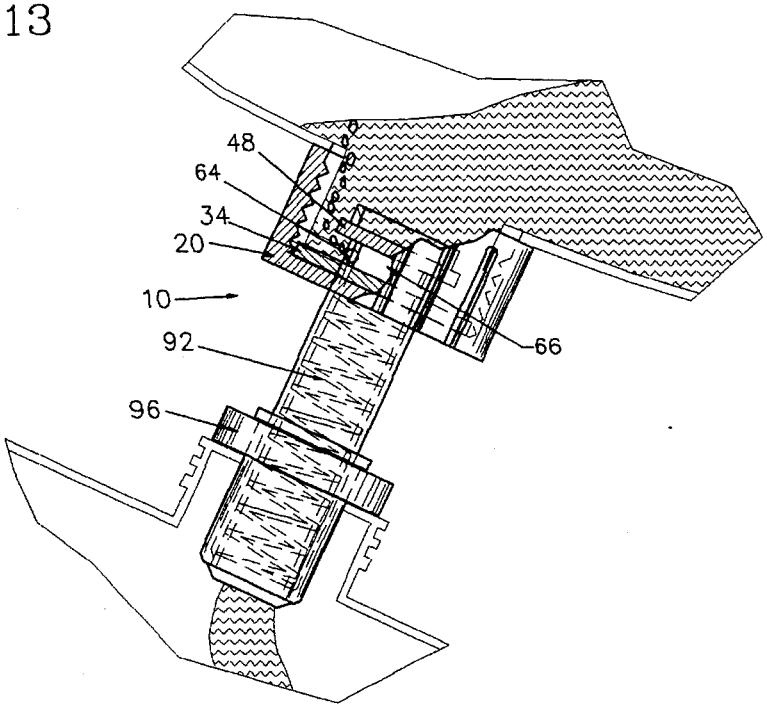
FIG. 14 is a cross-sectional view of the pour spout having an interior spring shown in pouring configuration with the valve means open.

FIG. 10 shows the pouring spout 10 which has a self-venting conduit 28 through which liquid and air pass between the supply container 12 and the target container. The self-venting conduit 28 has a tubular configuration and provides for liquid and air passage between the supply container 12 and the target container. The self-venting conduit 28 includes a spout body 30, which spout body 30 has a tubular configuration. The spout body 30 further has a proximate end 32 having an exterior flange 34 for securing the pouring spout 10 to an opening of the supply container 12 by the means of attachment 20. The self-venting conduit 28 has from one to a plurality of six air intake openings **42*a* and from one to a plurality of six air vent channels 62. By way of illustration, and not limitation, in one embodiment, as shown in FIG. 4, the spout body 30 has an interior extension 35 of flange 34, which interior extension 35 of flange 34 serves to constrain an interior spring biasing means 92 as is explained below. The spout body 30 further includes a distal end 40. The self-venting conduit 28 has a fluid discharge opening 42. By way of illustration, and not limitation, FIG. 8 shows an embodiment of the self-venting conduit 28 having a plurality of two air vent channels 62 in the spout body 30**.

Figure 7:
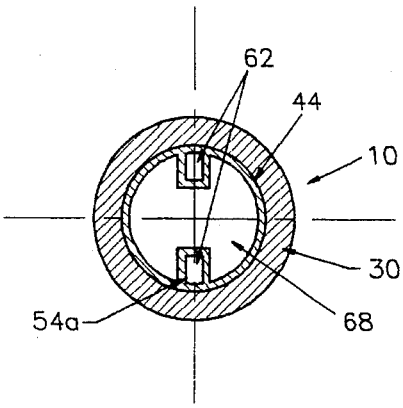
FIG. 7 is a top plan view of one embodiment of the pouring spout showing the travelling tube with two air vent channels incorporated therein.

The self-venting conduit 28 further includes a travelling tube 44 which has a tubular configuration and is slidably received within the spout body 30 such that the exterior wall surface of the travelling tube 44 closely conforms to the interior wall surface of the spout body 30. The travelling tube 44 has a proximate end 46 with a flange 48 thereon, which flange 48 seals with the flange 34 of the spout body 30. An outer planar surface 50 of the flange 48 of the travelling tube 44 seats against the inner planar surface 38 of the flange 34 of the spout body 30. The travelling tube 44 has a distal end 52 with a fluid discharge opening 54 from a common liquid channel 68. The travelling tube 44 has an external lip 58 in the shape of a bevelled enlarged rim which encircles the exterior of the distal end 52 of the travelling tube 44, which external lip 58 has an under edge 60. By way of illustration, and not limitation, FIG. 7 shows as embodiment of the self-venting conduit 28 having a plurality of two air vent channels 62 in the travelling tube 44 which extend longitudinally the length of the travelling tube 44, and thus the self-venting conduit 28, from the air intakes **54*a* on the distal end 52 of the travelling tube 44 to from one to a plurality of six air vent ports 64 on the proximate end 46 of the travelling tube 44. The air vent ports 64 are located in the immediate vicinity of the outer planar surface 50 of the flange 48 of the travelling tube 44. The air vent ports 64 provide air passage from the exterior of the self-venting conduit 28 through the air intakes 54a and the air vent channels 62 of the travelling tube 44 into the interior of the supply container 12. The travelling tube 44 has from one to a plurality of six liquid ports 66 which are located on the proximate end 46 of the travelling tube 44 having the flange 48 and which provide for passage of fluid into the common liquid channel 68 in the travelling tube 44 from the interior of the supply container 12**.

Figure 2:
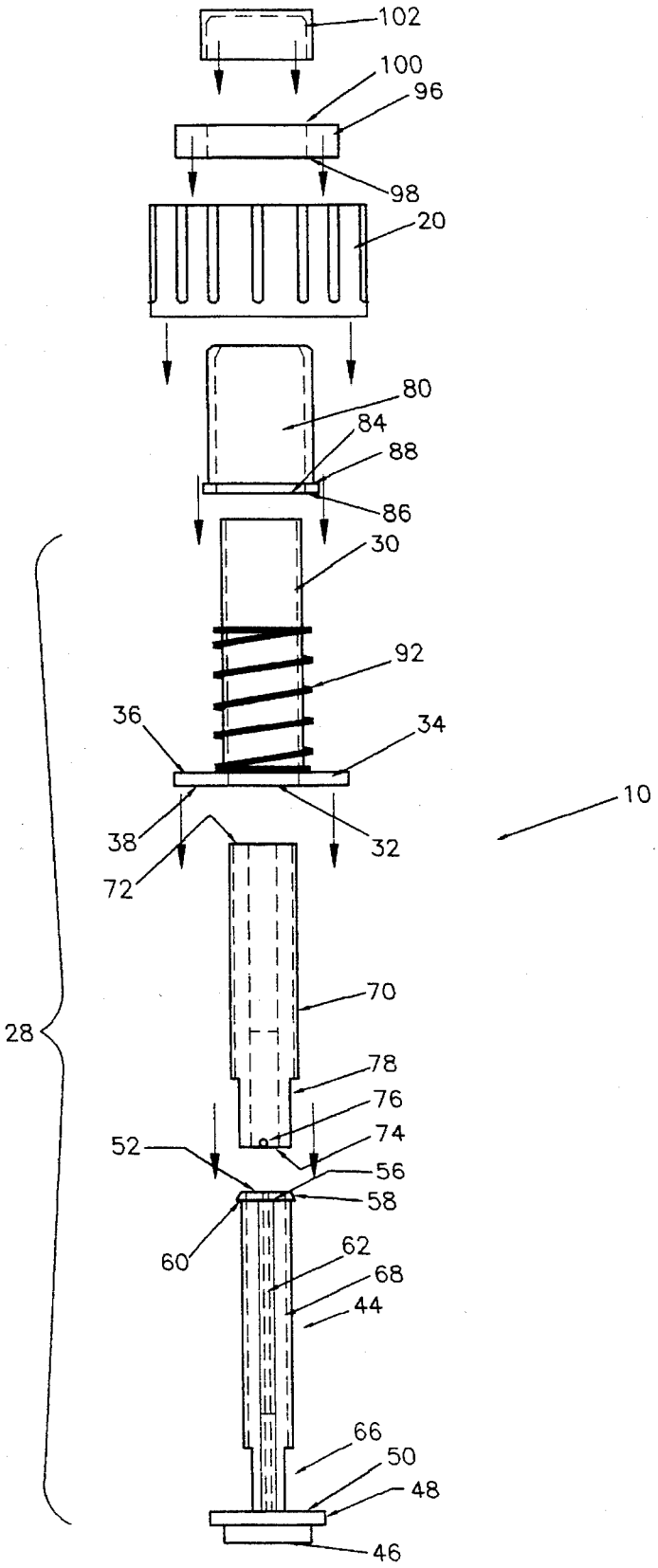
FIG. 2 is an exploded view of the components of one embodiment of the pouring spout, with sleeve embodiment shown.

By way of illustration, and not limitation, in one embodiment, as shown in FIG. 2, the self-venting conduit 28 includes a sleeve 70 which is of tubular configuration and of a length such that a distal end 72 of said .sleeve 70 abuts the under edge 60 of the external lip 58 on the distal end 52 of the travelling tube 44, and a proximate end 74 abuts the outer planar surface 50 of the flange 48 of the travelling tube 44. The sleeve 70 is slidably received within the spout body 30 and disposed between the interior wall of the spout body 30 and the exterior wall of the travelling tube 44 and closely conforms to both the interior wall of the spout body 30 and the exterior wall of the travelling tube 44. The sleeve 70 and travelling tube 44 are constrained to slide within the spout body 30 as one unit.

Figure 5:
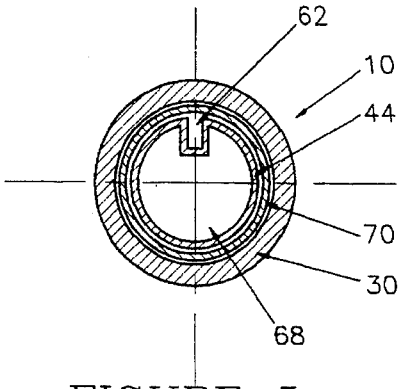
FIG. 5 is a top plan view of one embodiment of the pouring spout showing the travelling tube and sleeve with one air vent channel.
Figure 6:
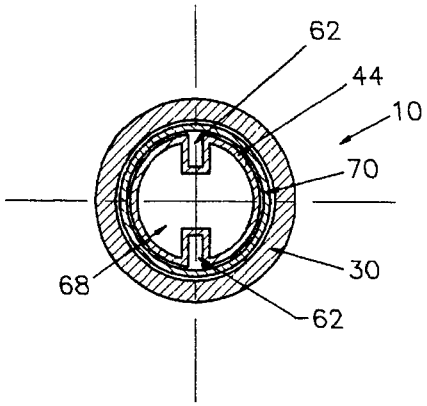
FIG. 6 is a top plan view of one embodiment of the pouring spout showing the travelling tube and sleeve with two air vent channels.

In one embodiment of the self-venting conduit 28, the sleeve 70 has from one to a plurality of six air vent ports 76 which are compatible with the air vent channels 62 of the self-venting conduit 28 in the travelling tube 44, and which are located on the proximate end 74 of the sleeve 70 in the immediate vicinity of the outer planar surface 50 of the flange 48 of the travelling tube 44. The air vent ports 76 of the sleeve 70 provide air passage from the air vent channels 62 of the self-venting conduit 28 through the sleeve 70 into the interior of the supply container 12 in the immediate vicinity of the outer planar surface 50 of the flange 48 of the travelling tube 44. In this embodiment, the travelling tube 44 does not have the air vent ports 64 on the proximate end 46 of the travelling tube 44 having the flange 48. Rather, as shown in FIGS. 5 and 6, the air vent channels 62 of the self-venting conduit 28 in the travelling tube 44 are not enclosed within the travelling tube 44, but utilize a wall of the sleeve 70 as a cooperating wall for the air vent channels 62 of the travelling tube 44. The sleeve 70 has from one to a plurality of six liquid ports 78 which are compatible with the liquid ports 66 of the travelling tube 44 and are located on the proximate end 74 of the sleeve 70 in the immediate vicinity of the outer planar surface 50 of the flange 48 of the travelling tube 44. The liquid ports 78 of the sleeve 70 provide for liquid passage into the common liquid channel 68 of the travelling tube 44 from the interior of the supply container 12.

By way of illustration, and not limitation, in one embodiment, as shown in FIG. 8, the air vent channels 62 of the self-venting conduit 28 are incorporated into the spout body 30, and extend the length of the spout body 30 from the distal end 40 with the fluid discharge opening 42 and air intake openings **42*a* to and through the flange 34 of the spout body 30, venting through air vent ports located on the inner planar surface 38 of the flange 34 of the spout body 30. In this embodiment, the outer planar surface 50 of the flange 48 on the travelling tube 44 seals the air vent ports on the inner planar surface 38 of the flange 34 on the spout body 30 when the pouring spout 10** is biased in closed position.

Figure 9:
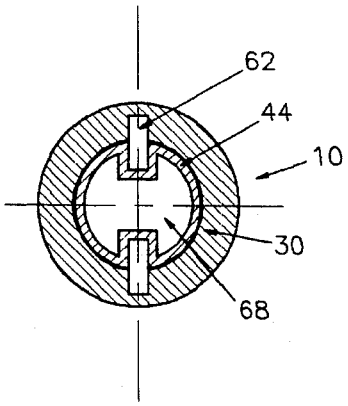
FIG. 9 is a top plan view of one embodiment of the pouring spout showing travelling tube and the spout body with two air vent channels incorporated as contours therebetween.

By way of illustration, and not limitation, in still another embodiment, as shown in FIG. 9, the air vent channels 62 of the self-venting conduit 28 are formed by complementary contours between the interior surface of the spout body 30 and the exterior surface of the travelling tube 44, and extend the length of the spout body 30 from the distal end 40 with the air intake openings **42*a* and fluid discharge opening 42 to the inner planar surface 38 of the flange 34 of the spout body 30**.

The pouring spout 10 has a dust cap 102 which seats on the distal end of the pouring spout 10, said dust cap 102 effectively covering and sealing the air intake openings **42*a* and fluid discharge opening 42 when the pouring spout 12** is configured for storage.

The pouring spout 10 has a valve means for regulating the transfer of fluid from the supply container 12 through the pouring spout 10 into the target container, with the valve means being normally biased in a closed position and moveable from the closed position to an open position, which open position allows for the passage of air and fluid through the pouring spout 10. The valve means utilizes the airtight integrity of the pouring spout 10 to regulate the transfer of fluid therethrough. Airtight integrity is provided by interaction of the various elements of the pouring spout 10. The means of attachment 20 provides an airtight seal between the pouring spout 10 and the threaded mouth 16 of the supply container 12 by securing the flange 34 of the spout body 30 to the threaded mouth 16 of the supply container 12 in airtight manner. The valve means has a hook 80, which hook 80 is secured in slidable manner on the distal end 40 of the spout body 30 having the fluid discharge opening 42 and the air intake openings **42*a* by means of a distal end 90 of the hook 80 abutting and securing to the under edge 60 of the external lip 58 of the travelling tube 44**.

The hook 80 is of tubular configuration and encircles the distal end 40 of the spout body 30 having the fluid discharge opening 42 and air intake openings **42*a* and is secured in place by means of the external lip 58 of the travelling tube 44. The hook 80 has a flange 84 on a proximate end 82 which flange 84 has an inner planar surface 86 and an outer planar surface 88**.

By way of illustration, and not limitation, in one embodiment, the valve means includes a hook ring 96 which encircles the hook 80 and attaches thereto by snap or other appropriate means. The hook ring 96 has an outer planar surface 100 upon which pressure is exerted to force the hook ring 96, and thus the hook 80, in the direction proximate to the supply container 12 to unbias and open the valve means. When the hook ring 96 is forced in the direction proximate to the supply container 12, the hook 80 is in turn forced in the direction proximate to the supply container 12 which compresses the spring biasing means 92 and causes the travelling tube 44, or the travelling tube 44 and the sleeve 70 if so configured, to be forced in the direction proximate to the supply container 12. As the travelling tube 44 is forced in the direction proximate to the supply container 12, the outer planar surface 50 of the flange 48 on the proximate end 46 of the travelling tube 44 unseats from the inner planar surface 38 of the flange 34 on proximate end 32 of the spout body 30. When the outer planar surface 50 of the flange 48 on the proximate end 46 of the travelling tube 44 unseats from the inner planar surface 38 of the flange 34 on the proximate end 32 of the spout body 30, the air vent ports 64 of the travelling tube 44, or the air vent ports 76 of the sleeve 70 if so configured, and the liquid ports 66 of the travelling tube 44, or the liquid ports 78 of the sleeve 70 if so configured, simultaneously open into the interior of the supply container 12 providing air intake and fluid discharge through the pouring spout 10.

The valve means is normally biased in closed position. Such biasing of the valve means in closed position is provided by spring biasing means 92. In normally biased closed position, the outer planar surface 50 of the flange 48 of the travelling tube 44 is forced onto the inner planar surface 38 of the flange 34 of the spout body 30 by the spring biasing means 92 putting pressure on the inner planar surface 86 of the hook 80 in a direction distal to the supply container 12 which in turn puts pressure on the under edge 60 of the external lip 58 of the travelling tube 44 resulting in the outer planar surface 50 of the flange 48 on the travelling tube 44 seating with the inner planar surface 38 of the flange 34 of the spout body 30 in airtight manner.

Figure 3:
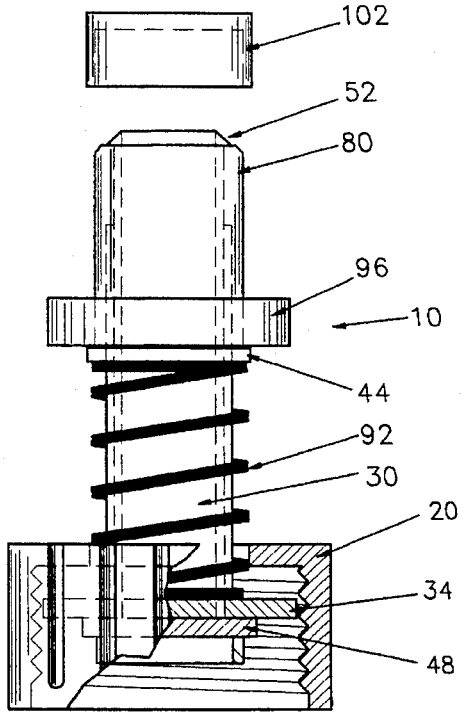
FIG. 3 is a longitudinal section of the pouring spout with the exterior spring of the spring biasing means shown.

By way of illustration, and not limitation, in one embodiment, as shown in FIG. 3, the spring biasing means 92 comprises an exterior spring which encircles the exterior wall of the spout body 30 and extends in compressed manner between the outer planar surface 36 of the flange 34 on the spout body 30 and the inner planar surface 86 of the flange 84 of the hook 80. Pressure on the hook 80 in the direction proximate to the supply container 12 compresses the exterior spring and forces the travelling tube 44, and sleeve 70 if so configured, into the interior of the supply container 12, unseating the outer planar surface 50 of the flange 48 on the travelling tube 44 from the inner planar surface 38 of the flange 34 of the spout body 30, and opening the air vent ports 64 of the travelling tube 44, or the air vent ports 76 of the sleeve 70 if so configured, and the liquid ports 66 of the travelling tube 44, or the liquid ports 78 of the sleeve 70 if so configured.

By way of illustration, and not limitation, in one embodiment, as shown in FIG. 4, the spring biasing means 92 comprises an interior spring which encircles the exterior wall of the travelling tube 44, or the travelling tube 44 and sleeve 70 if so configured, and is disposed within the spout body 30 and extends in compressed manner between the interior extension 35 of flange 34 of the spout body 30 and the inner surface of the distal end 90 of the hook 80. Pressure on the hook 80 in the direction proximate to the supply container 12 compresses the interior spring and forces the travelling tube 44, or the travelling tube 44 and sleeve 70 if so configured, into the interior of the supply container 12, unseating the outer planar surface 50 of the flange 48 on the travelling tube 44 from the inner planar surface 38 of the flange 34 of the spout body 30, and opening the air vent ports 64 of the travelling tube 44, or the air vent ports 76 of the sleeve 70 if so configured, and the liquid ports 66 of the travelling tube 44, or the liquid ports 78 of the sleeve 70 if so configured into the interior of the supply container 12.

In pouring configuration, the supply container 12 with the attached pouring spout 10 is inverted as shown in FIG.'s 11, 12, 13, and 14 and the pouring spout 10 inserted into the target container. No leakage occurs because the spring biasing means 92 keeps the flange 48 of the travelling tube 44 sealed against the flange 34 of the spout body 30. The pouring spout 10 is inserted into the target container until the outer planar surface 88 of the hook 80, or outer planar surface 100 of the hook ring 96 if so configured, engages the opening into the target container. Any leakage from the flanges 34,48 or from initial flow of liquid into the air vent channels 62 via the air vent ports 64,76 is constrained to flow into the target container. Compressing the spring biasing means 92 by putting pressure on the outer planar surface 88 of the hook 80, or outer planar surface 100 of the hook ring 96 if so configured, unseats the outer planar surface 50 of the flange 48 of the travelling tube 44 from the inner planar surface 38 of the flange 34 of the spout body 30, allowing liquid to flow into the liquid ports 66,78, the air vent ports 64,76 and the air vent channels 62 from the supply container 12. As a vacuum builds in the supply container 12, flow of liquid into the liquid ports 66,78, the air vent channels 62 and the air vent ports 64,76 decreases. The relative smaller size of the air vent ports 64,76 to the liquid ports 66,78 allows the flow of liquid in the air vent ports 64,76 to reverse resulting in air flowing into the supply container 12 when the relatively lower pressure in the supply container 12 at the air vent ports 64,76 overcomes any surface tension effects, inertial forces, viscous effects or other phenomenon inhibiting air/vapor flow into the supply container 12. The cross-sectional area (defined as perpendictular to the direction of flow) of the individual air vent ports 64,76 is always smaller than the cross-sectional area of the individual corresponding air vent channel 62 by a factor of less than 0.995 but greater than 0.01. The actual factor is selected to ensure that any liquid flowing down the air vent channels 62 from the interior of the supply container 12 does not completely fill the air vent channels 62. The pressure in the air vent channels 62 adjacent to the air vent ports 64,76 tends to approximate ambient pressure. This configuration promotes air flow into the supply container 12 because of the larger pressure difference between the fluid in the supply container 12 which is below ambient pressure and the air available adjacent to the air vent ports 64,76 which is at approximate ambient pressure. If the air vent channels 62 are filled with fluid, the pressure at the air vent ports 64,76 would be lower and nearer to that in the interior of the supply container 12, resulting in a reduced propensity for air to vent into the supply container 12. If the venting fails to occur automatically, the venting action can be started by decompressing the spring biasing means 92 until the flange 48 of the travelling tube 44 and the flange 34 of the spout body 30 seal, and then unsealing the flanges 48,34 by repeating the compression of the spring biasing means 92. Stopping the flow stops all flow into the air vent ports 64,76, and the liquid ports 66,78.

The supply container 12 will thus vent and drain until it is empty or the liquid level in the target container rises and covers the air intake openings 42*a* of the self-venting conduit 28 in the target container. If the air intake openings 42*a* of the self-venting conduit 28 in the target container are covered, the venting ceases as the liquid is too heavy to be drawn up the air vent channels 62 by the vacuum created by the relatively lower pressure in the interior of the supply container 12 and liquid from the supply container 12 will tend to fill the air vent ports 64,76, the air vent channels 62, the common liquid channel 68, and the liquid ports 66,78. Any leakage in the sealing of the flange 34 of the spout body 30 and the flange 48 of the travelling tube 44 is directed into the target container, as is the initial flow into the air vent ports 64,76 and the air vent channels 62. No leakage path other than to the inside of the target container is possible unless the means for attachment 20 or the pouring spout 10 lose structural integrity. When venting ceases, the vacuum in the supply container 12 increases until liquid flow stops. The supply container 12 can now be removed from the target container by raising the supply container 12 until the spring biasing means 92 moves the valve means to the normally closed position, sealing the outer planar surface 50 of the flange 48 on travelling tube 44 and the inner planar surface 38 of the flange 34 on the spout body 30. Any liquid remaining in the pouring spout 10 will drain into the target container and the supply container 12 may now be uprighted. The pouring spout 10 may now be configured for storage.

From the drawings and above description, it is apparent that a pouring spout constructed in accordance with the invention provides desirable features and advantages. While the form of the pouring spout herein described constitutes a preferred embodiment of the invention, it is to be understood that it is capable of further modification, and this application is intended to cover any variations, uses, or adaption of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed and desired to be secured by United States Letters Patent is:

1. A pouring spout through which liquid and air pass between a supply container and a target container, the said pouring spout comprising:

a self-venting conduit through which liquid and air pass between said supply container and said target container;

said self-venting conduit having a proximate end, said proximate end adapted to be attached to said supply container;

said self-venting conduit having a distal end, said distal end having at least one air intake opening and a fluid discharge opening;

said self-venting conduit having a spout body, said spout body having a tubular configuration;

said spout body having a proximate end and a distal end;

said spout body having a flange on said proximate end adapted to be attached to said supply container;

said self-venting conduit having a traveling tube, said traveling tube being of tubular configuration and being slidably received within said spout body;

said traveling tube having a proximate end;

said traveling tube having a flange on said proximate end, said flange sealing with said flange on said proximate end on said spout body;

said self-venting conduit having at least one air vent channel, said air vent channel extending a length of said self-venting conduit from said proximate end to said distal end;

said self-venting conduit having at least one air vent port, said air vent port being located adjacent to said flange on said traveling tube and corresponding with said air vent channel;

said traveling tube having at least one liquid port, said liquid port being located adjacent to said flange on said traveling tube;

said traveling tube having a common liquid channel, said common liquid channel extending the length of said traveling tube from said proximate end to said distal end, into which common liquid channel said liquid port opens;

said traveling tube having an external lip on said distal end;

said external lip of said traveling tube having an under edge;

said self-venting conduit having a means of attachment adapted to attach said self-venting conduit to said supply container in an airtight manner;

a valve means for regulating the transfer of air and liquid between said supply container and said target container, said valve means being normally biased in a closed position and being moveable from the closed position to an open position;

said valve means having said means of attachment adapted to secure said flange said spout body to said supply container in an airtight manner;

said valve means having a hook having a proximate end and a distal end, and said hook being secured in a slidable manner on said distal end of said spout body;

said hook having a flange on said proximate end;

said valve means having a means for biasing said valve means in the closed position by securing said hook on said spout body by urging said flange on said hook and thus said distal end of said hook against said under edge of said external lip on said traveling tube;

said distal end of said hook being urged against said under edge said external lip on said traveling tube in turn urging said flange on said proximate end of said traveling tube against said flange on said proximate end of said spout body; and, said means for normally biasing said valve means in a closed position being moveable from a closed position to an open position by a pressure being exerted on said hook in a direction proximate of said supply containers; and, a dust cap which seats on said distal end of said pouring spout.

2. A pouring spout as recited in claim 1 wherein said hook further comprises a hook which is of tubular configuration and encircles said distal end of said spout body.

3. A pouring spout as recited in claim 1 wherein said hook further comprises a hook ring which encircles and attaches to said hook, and upon which hook ring pressure is exerted to unbias said means for normally biasing said valve means in a closed position.

4. A pouring spout as recited in claim 1 wherein said means for normally biasing said valve means in a closed position further comprises an exterior spring on said spout body, which exterior spring extends in compressed manner between said flange on said spout body and said flange on said hook.

5. A pouring spout as recited in claim 1 wherein said means for normally biasing said valve means in a closed position further comprises an interior spring in said spout body, which interior spring extends in compressed manner between an interior extension of said flange on said spout body and an inner surface on said distal end of said hook.

6. A pouring spout as recited in claim 1 wherein said air vent channels in said self-venting conduit further comprise air vent channels incorporated into said spout body.

7. A pouring spout as recited in claim 1 wherein said air vent channels in said self-venting conduit further comprise air vent channels incorporated into said travelling tube.

8. A pouring spout as recited in claim 1 wherein said air vent channels in said self-venting conduit further comprise a contour between said spout body and said travelling tube.

9. A pouring spout as recited in claim 1 wherein said means of attachment further comprises an annular, threaded collar, which annular, threaded collar encircles said proximate end of said spout body.

10. A pouring spout through which liquid and air pass between a supply container and a target container, the said pouring spout comprising:

a self-venting conduit through which liquid and air pass between said supply container and said target container;

said self-venting conduit having a proximate end, said proximate end adapted to be attached to said supply container;

said self-venting conduit having a distal end, said distal end having at least one air intake opening and a fluid discharge opening;

said self-venting conduit having a spout body, said spout body having a tubular configuration;

said spout body having a proximate end and a distal end;

said spout body having a flange on said proximate end adapted to be attached to said supply container;

said self-venting conduit having a traveling tube, said traveling tube being of tubular configuration and being slidably received within said spout body;

said traveling tube having a proximate end;

said traveling tube having a flange on said proximate end, said flange sealing with said flange on said proximate end on said spout body;

said self-venting conduit having at least one air vent channel, said air vent channel extending a length of said self-venting conduit from said proximate end to said distal end;

said self-venting conduit having at least one air vent port, said air vent port being located adjacent to said flange on said traveling tube and corresponding with said air vent channel;

said traveling tube having at least one liquid port, said liquid port being located adjacent to said flange on said traveling tube;

said traveling tube having a common liquid channel, said common liquid channel extending the length of said traveling tube from said proximate end to said distal end, into which common liquid channel said liquid port opens;

said traveling tube having an external lip on said distal end;

said external lip of said traveling tube having an under edge;

said self-venting conduit having a sleeve, said sleeve having a tubular configuration and being slidably received within said spout body and disposed between said spout body and said traveling tube with said sleeve and traveling tube being constrained to slide within said spout body as one unit;

said sleeve having at least one air vent port, said air vent port being located on a proximate end of said sleeve and being compatible with said air vent channel of said self-venting conduit;

said sleeve having at least one liquid port, said liquid port being located on a proximate end of said sleeve and being compatible with said liquid port of said traveling tube;

said self-venting conduit having a means of attachment adapted to attach said self-venting conduit to said supply container in an airtight manner;

a valve means for regulating the transfer of air and liquid between said supply container and said target container, said valve means being normally biased in a closed position and being moveable from the closed position to an open position;

said valve means having said means of attachment adapted to secure said flange of said spout body to said supply container in an airtight manner;

said valve means having a hook, said hook having a proximate end and a distal end, and said hook being secured in a slidable manner on said distal end of said spout body;

said hook having a flange on said proximate end;

said valve means having a means for biasing said valve means in the closed position by securing said hook on said spout body by urging said flange on said hook and thus said distal end of said hook against said under edge of said external lip on said traveling tube;

said distal end of said hook being urged against said under edge of said external lip on said traveling tube in turn urging said flange on said proximate end of said traveling tube against said flange on said proximate end of said spout body; and, said means for normally biasing said valve means in a closed position being moveable from a closed position to an open position by a pressure being exerted on said hook in a direction proximate of said supply container; and, a dust cap which seats on said distal end of said pouring spout.

11. A pouring spout as recited in claim 10 wherein said hook further comprises a hook which is of tubular configuration and encircles said distal end of said spout body.

12. A pouring spout as recited in claim 10 wherein said hook further comprises a hook ring which encircles and attaches to said hook, and upon which hook ring pressure is exerted to unbias said means for normally biasing said valve means in a closed position.

13. A pouring spout as recited in claim 10 wherein said means for normally biasing said valve means in a closed position further comprises an exterior spring on said spout body, which exterior spring extends in compressed manner between said flange on said spout body and said flange on said hook.

14. A pouring spout as recited in claim 10 wherein said means for normally biasing said valve means in a closed position further comprises an interior spring in said spout body, which interior spring extends in compressed manner between an interior extension of said flange on said spout body and an inner surface on said distal end of said hook.

15. A pouring spout as recited in claim 10 wherein said means of attachment further comprises an annular, threaded collar, which annular threaded collar encircles said proximate end of said spout body.

16. A pouring spout as recited in claim 10 wherein said air vent channels of said self-venting conduit further comprise air vent channels incorporated into said spout body.

17. A pouring spout as recited in claim 10 wherein said air vent channels of said self-venting conduit further comprise air vent channels incorporated into said travelling tube.

18. A pouring spout as recited in claim 10 wherein said air vent channels of said self-venting conduit further comprise air vent channels in said travelling tube utilizing a wall of said sleeve as a wall of said air vent channel.

* * * * *